US007874795B2

(12) United States Patent
Burdgick et al.

(10) Patent No.: US 7,874,795 B2
(45) Date of Patent: Jan. 25, 2011

(54) TURBINE NOZZLE ASSEMBLIES

(75) Inventors: Steven S. Burdgick, Guilderland, NY (US); Thomas W. Crall, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 1408 days.

(21) Appl. No.: 11/518,708

(22) Filed: Sep. 11, 2006

(65) Prior Publication Data

US 2010/0221108 A1 Sep. 2, 2010

(51) Int. Cl.
*F03B 3/16* (2006.01)

(52) U.S. Cl. ..... 415/191; 415/209.3; 415/209.4

(58) Field of Classification Search ..... 415/100, 415/191, 209.3, 209.4, 210.1
See application file for complete search history.

(56) References Cited

U.S. PATENT DOCUMENTS 1,740,800 A * 12/1929 Wiberg ..... 29/889.21
1,998,951 A * 4/1935 Downer ..... 415/209.4
4,571,153 A * 2/1986 Keller ..... 415/117
4,764,084 A * 8/1988 Parker et al. ..... 415/101
5,295,301 A * 3/1994 Knorowski ..... 29/888.021
5,593,273 A * 1/1997 Brinkman ..... 415/108
5,743,711 A * 4/1998 Fournier et al. ..... 415/209.2
5,788,456 A * 8/1998 Maier ..... 415/190
6,048,169 A * 4/2000 Feldmuller et al. ..... 415/115

* cited by examiner

*Primary Examiner*—Igor Kershteyn
(74) *Attorney, Agent, or Firm*—Mark E. Henderson; Ernest G. Cusick; Frank A. Landgraff

(57) ABSTRACT

A nozzle assembly for a turbine that may include: (1) a nozzle blade having inner and outer sidewalls and, in part, defining a flowpath upon assembly into the turbine; (2) an outer ring; (3) a flowsplitter having a horizontal extension; (4) an interface between the outer ring and the outer sidewall having at least one of (i) a male/female interface or (ii) a radial interlock; and (5) an interface between the horizontal extension and the inner sidewall having at least one of (i) the male/female interface or (ii) the radial interlock. In some embodiments, one of the interface between the outer ring and the outer sidewall and the interface between the horizontal extension and the inner sidewall comprises a weld and one of the interface between the outer ring and the outer sidewall and the interface between the horizontal extension and the inner sidewall is weld free.

22 Claims, 5 Drawing Sheets

TURBINE NOZZLE ASSEMBLIES

TECHNICAL FIELD

The present invention relates to nozzle assemblies for turbines. More specifically, but not by way of limitation, the present application relates to singlet nozzle assemblies in the first stage of a double flow steam turbine.

BACKGROUND OF THE INVENTION

Steam turbines typically comprise static nozzle segments that direct the flow of steam onto rotating turbine blades or buckets that are connected to a rotor. In steam turbines, the nozzle, which may form an airfoil or blade, is typically called a diaphragm stage.

In general, diaphragm stages are constructed using one of two methods. A first method uses a band/ring construction wherein the airfoils are first welded between inner and outer bands, which extend about 180°. Those arcuate bands with welded airfoils are then assembled and welded between the inner and outer carrier rings of the stator of the turbine. The second construction method consists of having the airfoils or blades of the nozzle welded directly to inner and outer rings. In this method, the nozzles generally have integral sidewalls that are used to make the interface with the inner and outer rings. This method is typically used for larger steam turbine units where access for creating the weld is available.

There are inherent limitations using the band/ring method of construction. A principle limitation in the band/ring assembly method is the distortion that occurs to the flowpath because of the weld that is used. That is, the weld used for these assemblies is of considerable size and heat input. The weld either requires high heat input and a significant quantity of metal filler or is very deep electron beam welds. In either case, the material or heat input causes the flow path to significantly distort. For example, material shrinkage causes the airfoils to bow outward from their designed shaped into the flow path. In many cases, the airfoils of the nozzle assemblies require adjustment and stress relief after welding.

The result of the steam path distortion (which may be present in some degree even after corrective post-assembly measures are taken) is reduced diaphragm stage efficiency. The surface profiles of the inner and outer bands also may change as a result of welding the nozzles into the stator assembly further causing an irregular flow path. More specifically, the nozzles and bands generally bend and distort as a result of conventional installation methods. This requires substantial finishing of the nozzle configuration to bring it into design specifications. In many cases, approximately 30% of the costs of the overall construction of the nozzle assembly is spent on deforming the nozzle assembly, including after welding and stress relief, to bring it back to its design configuration.

The second nozzle construction method (i.e., having the sidewalls of the airfoils or blades of the nozzle welded directly to the inner and outer rings) also has significant issues and inefficiencies. For example, conventional assembly methods that use a single nozzle construction welded into rings lack the proper configuration to promote a determined weld depth at the interface, which generally causes problems to arise. Further, conventional systems lack assembly alignment features on both the inner and outer ring, which may aid in installation. Also, conventional systems lack retainment features that may hold the installed nozzle in place in the event of a weld failure. Finally, conventional systems require time-consuming welds at both of the nozzle-inner ring interface and the nozzle-outer ring interface.

In addition, in the first stage of a double flow steam turbine, many of the issues associated with the construction of the nozzle assemblies may be exacerbated. However, certain characteristics of the first stage, which is often referred to as the tub stage, offer design opportunities that may be used to simplify nozzle assembly in that stage and make the assembly process more efficient. For example, the flow-splitter takes the place of the inner ring in the first stage and has beneficial characteristics that may be used. As discussed in more detail below, conventional nozzle design has failed to take advantage of these opportunities.

Accordingly, there is a need for a first stage nozzle that is designed to be installed by either sliding the nozzle into place or with limited low input heat welds or both. In either case, such assembly will minimize or eliminate steam path distortion that results from conventional welding processes, as well as improving production and cycle costs by making assembly more efficient. Further, there is a need for a first stage nozzle assembly that facilitates alignment of nozzle assembly during installation and creates a mechanical lock to prevent downstream movement of the nozzle assembly in the event of a weld failure. Certain unique characteristics of the first stage, which are not found in the downstream stages, may be taken advantage of in first stage nozzle design to efficiently satisfy these demonstrated needs.

BRIEF DESCRIPTION OF THE INVENTION

The present application thus describes a nozzle assembly for a turbine that may include: (1) a nozzle blade having inner and outer sidewalls and, in part, defining a flowpath upon assembly into the turbine; (2) an outer ring; (3) a flowsplitter having a horizontal extension; (4) an interface between the outer ring and the outer sidewall having at least one of (i) a male/female interface or (ii) a radial interlock; and (5) an interface between the horizontal extension and the inner sidewall having at least one of (i) the male/female interface or (ii) the radial interlock. In some embodiments, one of the interface between the outer ring and the outer sidewall and the interface between the horizontal extension and the inner sidewall includes a weld and one of the interface between the outer ring and the outer sidewall and the interface between the horizontal extension and the inner sidewall is weld free.

In some embodiments, the radial interlock may include either (i) a first male step projecting axially from the inner sidewall into the horizontal extension, the first male step being flanked on its most outwardly radial side by a second male step projecting axially from the horizontal extension into the inner sidewall, or (ii) a first male step projecting axially from the outer sidewall into the outer ring, the first mail step being flanked on its most inwardly radial side by a second male step projecting axially from the outer ring into the outer sidewall. The male/female interface may include either (i) a radial female recess on the outer sidewall that corresponds with a radial male step on the outer ring, or (ii) a radial female recess in the inner sidewall that corresponds to a radial male step on the horizontal extension.

In some embodiments, the interface between the outer ring and the outer sidewall may include the male/female interface positioned at a trailing edge of the outer sidewall. The interface between the horizontal extension and the inner sidewall may include the radial interlock positioned at a leading edge of the inner sidewall. The male/female interface positioned at the trailing edge of the outer sidewall may be welded. The weld may include a butt weld such that the weld is substantially limited to the area between the outer sidewall and the outer ring along the axial length of male/female interface. The axial length of male/female interface positioned at the trailing edge of the outer sidewall may be less than about ¼ of the axial extent of the registration between the outer ring and the outer sidewall.

The horizontal extension further may include a downstream lip. The downstream lip may cover the downstream edge of the inner sidewall such that the downstream lip prevents axial displacement of the inner sidewall in the downstream direction.

In some embodiments, the interface between the outer ring and the outer sidewall may include one of the radial interlocks positioned at both a leading edge and a trailing edge of the outer sidewall. The interface between the horizontal extension and the inner sidewall may include the male/female interface positioned at a trailing edge of the inner sidewall. The male/female interface positioned at the trailing edge of the inner sidewall may be welded using a butt weld interface such that the weld is substantially limited to the area between the inner sidewall and the horizontal extension along the axial length of male/female interface. The axial length of male/female interface positioned at the trailing edge of the inner sidewall may be less than about ¼ of the axial extent of the registration between the inner sidewall and the horizontal extension.

The present application further describes a nozzle assembly for a turbine that may include: a nozzle blade having inner and outer sidewalls and, in part, defining a flowpath upon assembly into the turbine; an outer ring; a flowsplitter having a horizontal extension; an interface between the outer ring and the outer sidewall having at least one of (i) a radial interlock; (ii) a male/female interface; or (iii) a female recess flanked by radially projecting male steps at both a leading and a trailing edge of the outer sidewall; and an interface between the horizontal extension and the inner sidewall having at least one of (i) the radial interlock; (ii) the male/female interface; or (iii) the female recess flanked by radially projecting male steps at both a leading and a trailing edge of the inner sidewall.

In some embodiments, the radial interlock may include either (i) a first male step projecting axially from the inner sidewall into the horizontal extension, the first male step being flanked on its most outwardly radial side by a second male step projecting axially from the horizontal extension into the inner sidewall, or (ii) a first male step projecting axially from the outer sidewall into the outer ring, the first mail step being flanked on its most inwardly radial side by a second male step projecting axially from the outer ring into the outer sidewall. The male/female interface may include either (i) a radial female recess on the outer sidewall that corresponds with a radial male step on the outer ring, or (ii) a radial female recess in the inner sidewall that corresponds to a radial male step on the horizontal extension.

The interface between the outer ring and the outer sidewall may include one of the radial interlocks positioned at the leading edge and the trailing edge of the outer sidewall. The interface between the horizontal extension and the inner sidewall may include the female recess flanked by radially projecting male steps at the leading edge and the trailing edge of the inner sidewall. The interface between the male step at the trailing edge of the inner sidewall and the horizontal extension may be welded. The weld may include a butt weld such that the weld is substantially limited to the area between the inner sidewall and the horizontal extension along the axial length of male step at the trailing edge of the inner sidewall. The axial length of male step positioned at the trailing edge of the inner sidewall may be less than about ¼ of the axial extent of the registration between the inner sidewall and the horizontal extension. The inner sidewall further may be bolted to the horizontal extension by a bolt. The bolt may be positioned such that the bolt extends radially through the horizontal extensions into the inner sidewall.

In some embodiments, the interface between the outer ring and the outer sidewall may include the male/female interface positioned at the trailing edge of the outer sidewall. The interface between the horizontal extension and the inner sidewall may include the female recess flanked by radially projecting male steps at the leading and the trailing edges of the inner sidewall. The interface between the male step at the trailing edge of the inner sidewall and the horizontal extension may be welded. The weld may include a butt weld such that the weld is substantially limited to the area between the inner sidewall and the horizontal extension along the axial length of the male step at the trailing edge of the inner sidewall. The axial length of male step at the trailing edge of the inner sidewall may be less than about ¼ of the axial extent of the registration between the inner sidewall and the horizontal extension. The male/female interface positioned at the trailing edge of the outer sidewall may be welded. The weld comprising a butt weld such that the weld is substantially limited to the area between the outer sidewall and the outer ring along the axial length of male/female interface. The axial length of male/female interface positioned at the trailing edge of the outer sidewall may be less than about ¼ of the axial extent of the registration between the outer sidewall and the outer ring.

In some embodiments, the flow splitter may include a single piece. An vertical extension of the flow splitter may have a greater outward radial height than the outward radial height of upstream interface between the outer sidewall and the outer ring. In some embodiments, the outer ring may include a solid ring and an outer carrier ring assembly.

The present application further describes a nozzle assembly for a turbine that may include: a nozzle blade having inner and outer sidewalls and, in part, defining a flowpath upon assembly into the turbine; an outer ring; a flowsplitter having a horizontal extension; means for providing a mechanical engagement that includes a weld stop and a failsafe between an interface between the outer ring and the outer sidewall; and means for providing a mechanical engagement that includes a radial interlock between an interface between the inner ring and the horizontal extension.

In some embodiments, the weld stop may include a backstop that determines the depth of a weld at the interface between the outer ring and the outer sidewall. The failsafe may include a mechanical stop that prevents the downstream axial displacement of the outer sidewall. In some embodiments, the means for providing a mechanical engagement that includes a weld stop and a failsafe may include either (i) a male/female interface or (ii) a female recess flanked by radially projecting male steps at both a leading edge and a trailing edge of the outer sidewall. The male/female interface may include a radial female recess on the outer sidewall that corresponds with a radial male step on the outer ring.

The means for providing a mechanical engagement that includes a radial interlock may include a first male step projecting axially from the inner sidewall into the horizontal extension. The first male step may be flanked on its most outwardly radial side by a second male step projecting axially from the horizontal extension into the inner sidewall.

The present application further describes a nozzle assembly for a turbine that may include: a nozzle blade having inner and outer sidewalls and, in part, defining a flowpath upon assembly into the turbine; an outer ring; a flowsplitter having a horizontal extension; means for providing a mechanical engagement that includes a radial interlock between an interface between the outer ring and the outer sidewall; and means for providing a mechanical engagement that includes a weld stop and a failsafe between an interface between the inner ring and the horizontal extension.

In some embodiments, the weld stop may include a backstop that determines the depth of a weld at the interface. The failsafe may include a mechanical stop that prevents the downstream axial displacement of the outer sidewall. In some embodiments, the means for providing a mechanical engagement that includes a weld stop and a failsafe may include either (i) a male/female interface or (ii) a female recess flanked by radially projecting male steps at both a leading edge and a trailing edge of the inner sidewall. The male/female interface may include a radial female recess on the inner sidewall that corresponds with a radial male step on the horizontal extension.

In some embodiments, the means for providing a mechanical engagement that includes a radial interlock may include a first male step projecting axially from the outer sidewall into the outer ring. The first mail step may be flanked on its most inwardly radial side by a second male step projecting axially from the outer ring into the outer sidewall.

The present application further describes a nozzle assembly for a turbine that may include: a nozzle blade having inner and outer sidewalls and, in part, defining a flowpath upon assembly into the turbine; an outer ring; a flowsplitter having a horizontal extension; an interface between the outer ring and the outer sidewall having at least one of (i) a radial interlock; (ii) a male/female interface; or (iii) a female recess flanked by radially projecting male steps at both a leading edge and a trailing edge of the outer sidewall; and an interface between the horizontal extension and the inner sidewall having a hook and slot connection. The hook and slot connection may include a hook that extends radially from the leading edge of inner sidewall and a corresponding circumferential slot in the horizontal extension.

In some embodiments, the interface between the outer ring and the outer sidewall may include a male/female interface positioned at both the leading and the trailing edge of the outer sidewall. The male/female interface positioned at the trailing edge of the outer sidewall may be welded. The weld may include a butt weld such that the weld is substantially limited to the area between the outer sidewall and the outer ring along the axial length of male/female interface. The axial length of male/female interface positioned at the trailing edge of the outer sidewall may be less than about ¼ of the axial extent of the registration between the outer ring and the outer sidewall. The outer ring may include a solid ring and an outer carrier ring assembly.

These and other features of the present application will become apparent upon review of the following detailed description of the preferred embodiments when taken in conjunction with the drawings and the appended claims.

DETAILED DESCRIPTION OF THE INVENTION

Figure 1:
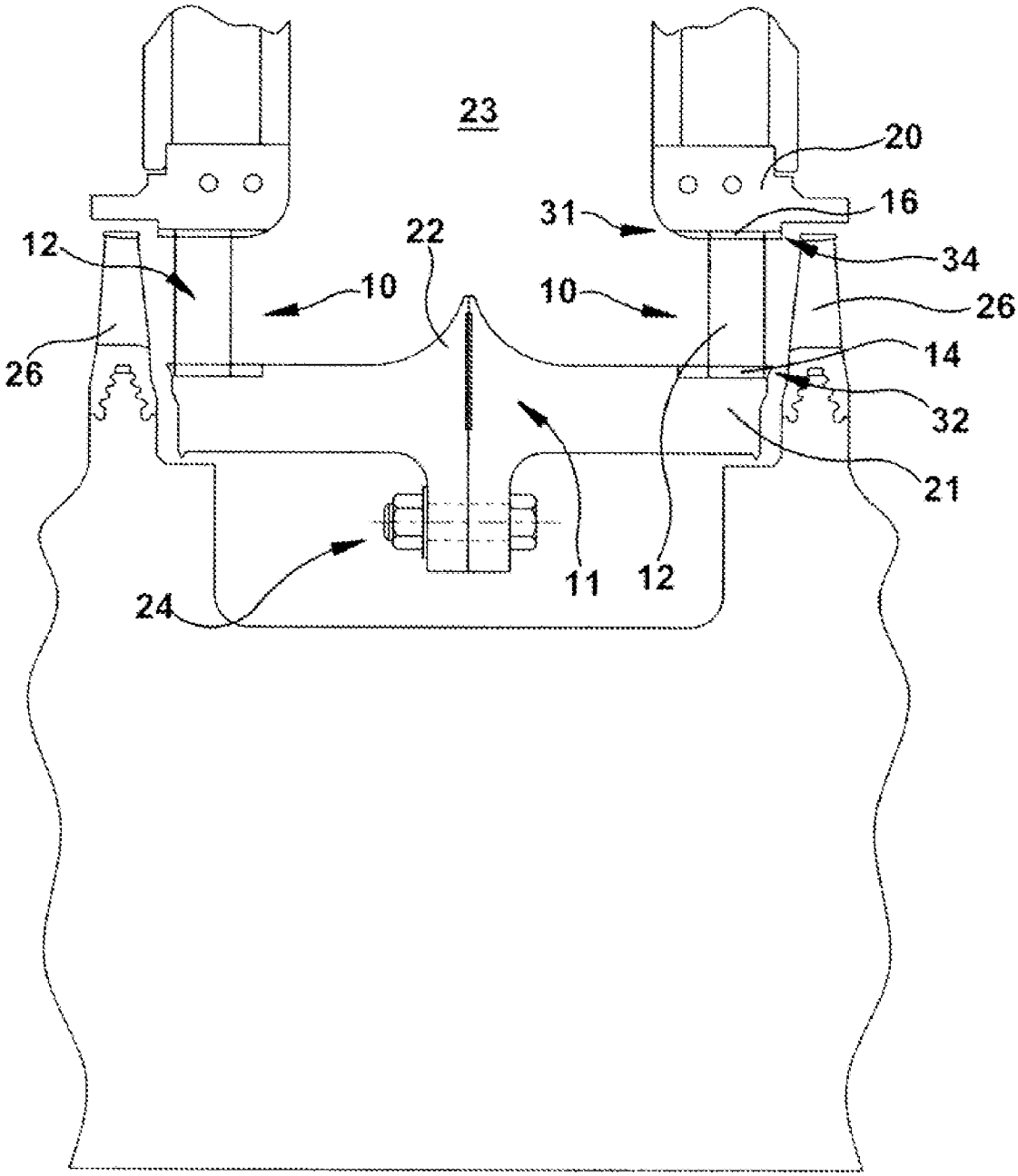
FIG. 1 PRIOR ART
FIG. 1 is a schematic line drawing illustrating a cross-section through the first stage of a double flow steam turbine nozzle according to the prior art.

Referring to FIG. 1, there is illustrated a prior art first stage nozzle assembly generally designated 10, which, in a double flow steam turbine system, may include the nozzle assembly 10 on each side of a flow splitter 11. Nozzle assembly 10 may include a plurality of circumferentially spaced airfoils or blades 12, which may be welded at opposite ends between an inner band 14 and an outer bands 16. The outer band 16 may be welded to an outer ring 20. The inner band 14 may be welded to a horizontal extension 21 of the flow splitter 11. The flow splitter 11 also may have a vertical extension 22 that narrows to a peak in the approximate center of an inlet steam bowl 23. Note that the horizontal extension 21 and the vertical extension 22 generally denote conventional parts within known flow splitters 11 and are not meant to indicate specialized parts or configurations for the flow splitter 11. With this configuration, the vertical extension 22 of the flow splitter 11 may divide the flow of steam through the inlet steam bowl 23, directing substantially half of the flow to each of the nozzle assemblies 10. The flow splitter 11 may be constructed such that it includes two halves that may be brought together by a bolted connection 24. Also illustrated is a plurality of turbine blades or buckets 26 mounted on a rotor (not shown). It will be appreciated that nozzle assembly 10 in conjunction with the buckets 22 may form a stage of a steam turbine.

The airfoils 12 may be individually welded in generally correspondingly shaped holes, not shown, in the inner and outer bands 14 and 16. The inner and outer bands 14 and 16 typically extend in two segments each of about 180 degrees. After the airfoils 12 are welded between the inner band 14 and the outer band 16, this subassembly is then welded between the outer rings 20 and the horizontal extension 21 of the flow splitter 11 using very high heat input and deep welds. For example, the inner band 14 may be welded to the horizontal extension 21 by a weld 30 from a downstream location. The weld 30 may use a significant quantity of metal filler or requires a very deep electron beam weld to make a sufficient connection. Similarly, high heat input welds 31, 32, which may include substantial quantities of metal filler or very deep electron beam welds, may be required to weld the outer band 16 to the outer ring 20 at opposite axial locations (i.e., from an upstream and downstream location), as illustrated. Thus, when the airfoils 12 are initially welded to the inner and outer bands 14, 16 and subsequently welded to the horizontal extension 21 and the outer ring 20, those large welds may cause substantial distortion of the flowpath, causing the airfoils to deform from their design configuration, as a result of the high heat input and shrinking of the metal material. Also, the inner and outer bands 14, 16 may become irregular in shape from their designed shape, further distorting the flowpath. As a result, the nozzle assemblies, through time-consuming welding and stress relief, must be reformed back to their design configuration which, as noted previously, can result in 30% of the cost of the overall construction of the nozzle assembly. Lastly, if an electron beam weld is used, it necessarily must be completed from one direction going all the way to the opposing side, which may result in a weld of up to 4 inches thick. Beside the distortion problems associated with the heat input, such a large weld of this nature may lead to inconsistencies and connective issues at the interface.

Further, in regard to conventional assembly methods, as described, there are nozzle assemblies that are welded directly to the horizontal extension 21 and the outer ring 20 using a weld, generally an electron beam weld, at the interface. However, such known nozzle assemblies lack a configuration that promotes a determined weld depth at the interface. More specifically, weld depths in conventional systems often vary because the gap between the sidewalls of the nozzle singlet and rings is not consistent. As the gap becomes larger, due to machining tolerance ranges, the weld depths and properties of the weld change. A tight weld gap may produce a shorter than desired weld. A larger weld gap may drive the weld or beam deeper and may cause voids in the weld that are undesirable. In addition, current nozzle designs that include integral inner and outer sidewalls also use weld prep at the interface, which requires an undesirable higher heat input filler weld technique to be used. The higher heat may cause undesirable flowpath distortion. Further, as described, the conventional assemblies lack alignment features, which may aid in aligning the nozzle in the proper position during installation, retainment features, which may hold an installed nozzle in place in the event of a weld failure, and require time-consuming welds at both of the nozzle-horizontal extension interface and the nozzle-outer ring interface Referring now to FIG. 2, there is illustrated an embodiment of a first stage nozzle assembly 40 according to the present application that utilizes a first stage singlet. As used herein, a first stage singlet is a single nozzle airfoil with sidewalls or other attachment means at each end which may be attached between the horizontal extension 21 of the flow splitter 11 and the outer ring 20 directly, for example with a low heat input weld or by slide engagement or bolting. As described herein, a first stage singlet may have mechanical features providing improved reliability and risk abatement (such as a mechanical lock at the interface between the singlet and the horizontal extension 21 and/or the outer ring 20 that holds the installed singlet in place in the event of a weld failure). As further described herein, a first stage singlet may have alignment features that aid in installation and a configuration that promotes a determined weld depth at the interface between the singlet and the horizontal extension 21 and the outer ring 20. Note also that FIGS. 2-6 demonstrate a conventional outer ring assembly. As used herein, outer ring is defined broadly to also include solid ring or band/outer carrier ring assemblies, such as the one described in connection with FIG. 7. The embodiments discussed herein are able to be used with either outer ring assembly and are not so limited to the conventional outer ring assembly of FIGS. 2-6.

Figure 2:
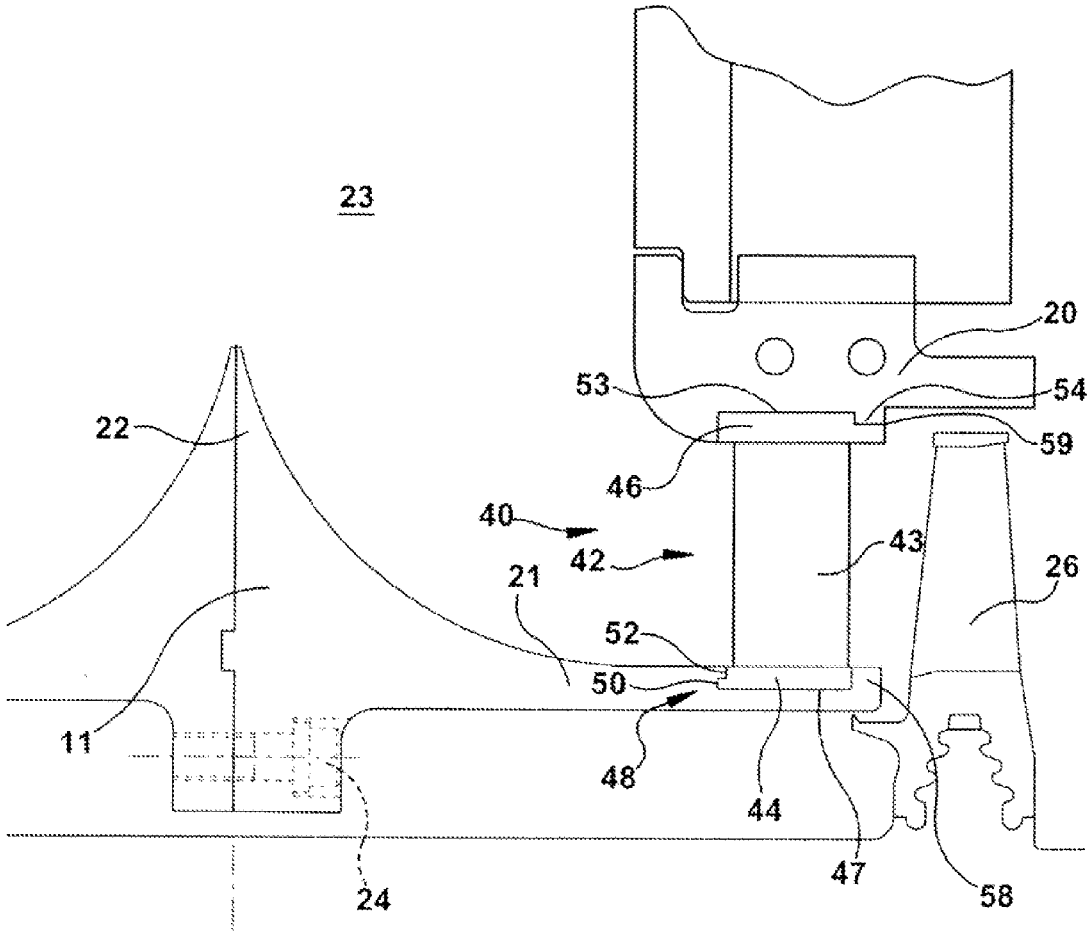
FIG. 2 is a schematic line drawing illustrating a cross-section through the first stage of a double flow steam turbine incorporating a nozzle assembly in accordance with an embodiment of the present application.

Accordingly, the exemplary embodiment of the first stage nozzle assembly 40 of FIG. 2 may include an integrally formed first stage singlet 42, which may include a single airfoil or blade 43 between an inner sidewall 44 and an outer sidewall 46, respectively. The airfoil 43 and sidewalls 44, 46 may be machined from a near net forging or a block of material. The inner sidewall 44 may insert into a slot 47 within the horizontal extension 21 of the flow splitter 11. The upstream side of the slot 47/inner sidewall 44 interface may include a radial interlock 48. As used herein, radial interlock is defined as a pair of axially overlapping male steps that prohibit radial movement of the singlet. As illustrated, this may be formed by providing a male step 50 axially projecting from the inner sidewall 44 into the horizontal extension 21 and a overlapping second male step 52 axially projecting from the horizontal extension 21 into the inner sidewall 44. The male step 52 may flank the male step 50, and the male step 52 may be further outward radially, such that it substantially locks the inner sidewall 44 within the slot 47 and prohibits radial movement of the first stage singlet 42. Note that when a radial interlock is positioned on the outer sidewall 46, as discussed below in alternative embodiments, the overlapping male step of the outer ring 20 will be further inward radially than the male step of the outer sidewall 46. The slot 47 further may include a downstream lip 58 that covers the downstream edge of the inner sidewall 44, thus preventing the axial displacement of the inner sidewall 44 in the downstream direction. Thus, given the configuration of the slot 47, the inner sidewall 44 may engage the horizontal extension 21 by being slid into the slot 47.

The outer sidewall 46 may insert into a slot 53 within the outer ring 20. At the downstream side of the slot 53, a radial male/female interface 54 may be formed, which, as described in more detail below, may provide a weld stop (which may promote a determined, shallow depth weld for the efficient attachment of the outer sidewall 46 to the outer ring 20) and a failsafe (i.e., a mechanical stop or retainment features that may hold the installed nozzle in place axially in the event of a weld failure). The male/female interface 54 may include a radial female recess in the outer sidewall 46 that corresponds with a radial male step on the outer ring 20.

The configuration of first stage nozzle assembly 40 may allow for the efficient installation of first stage singlet 42, which may proceed as follows. The first stage singlet 42 may be slid into the slot 47 and, thus, engage the horizontal extension 21 through the configuration of the radial interlock 48 and the downstream lip 58. The outer sidewall 46 then may be introduced into the outer ring 20 and the male/female interface 54 aligned. Note that the features of the slot 47 and the slot 53, i.e., the radial interlock 48, the downstream lip 58, the male/female interface 54, etc., may provide for the proper axial and radial alignment of the first stage singlet 42 during installation.

The first stage singlet 42 then may be fixed into place between the horizontal extension 21 and the outer ring 20 by using a low heat input type weld 59 at the male/female interface 54. For example, the low heat input type weld 59 may use a butt weld interface and preferably employ a shallow electron beam weld or shallow laser weld or a shallow TIG or GTAW weld process. By using these weld processes and types of welds, the weld 59 may be limited to the area between the outer sidewall 46 and outer ring 20 along the axial length of male/female interface 54. That is, the radial offset of the male/female interface 54 results in what is essentially a "backstop" that limits the length of the weld. Thus, the weld 59 may occur for only a short, determined axial distance, and not exceed the axial length of the male/female interface 54. The weld 59 also may proceed without the use of filler weld material. As illustrated, less than about ¼ of the axial distance spanning the outer sidewall 46 maybe used in weld 59 to weld the first stage singlet 42 to the outer ring 20.

Accordingly, by using electron beam welding in an axial direction from the downstream side of the interface between the outer sidewall 46 and the outer ring 20, the axial extent of the weld where the materials of the outer sidewall 46 and ring 20 coalesce is less than about ¼ of the extent of their axial interface. In conventional systems that lack the weld stop of the male/female interface 54, if an electron beam weld is used, the weld would necessarily extend throughout the full axial extent of the registration, i.e., the length of the interface, between the sidewall 46 and the ring 20. As previously described, this may cause distortion and issues with the weld connection to arise.

As illustrated, in the first stage, the singlet 42 may be supported or held in place axially by the horizontal extension 21 of the flow splitter 11. Because of this additional axial support, the non-weld attachment made by the radial interlock 48 and the downstream lip 58 between the inner sidewall 44 and the horizontal extension 21 may be sufficient. In the other subsequent turbine stages, nozzle and inner ring assemblies are essentially cantilevered from the outer ring and, thus, undergo substantial stressing and distortion due to the high-velocity cross-flow of steam. These conditions generally make welding the inner sidewall 44 to the inner ring necessary, a practice which also is essentially done in the first stage as the inner sidewall 44 is welded to the horizontal extension 21 of the flow splitter 11. In the first stage, though, the horizontal extension 21 is available to provide axially support to the inner sidewall 44 (which in this embodiment is accomplished by the downstream lip 58), which may counter-act the stresses and distortion caused by the cross-flow of steam. Thus, the added axial support provided in the first stage may allow for a sufficient non-weld connection of the first stage singlet 42, which has been demonstrated in FIG. 1 with the non-weld interface between the horizontal extension 21 and the inner sidewall 44. Thus, as demonstrated in more detail in the following exemplary embodiments, the first stage single 42 may be efficiently installed by making a single weld at only on of its sidewall interfaces (as opposed to both) or, in some embodiments, by making no welds at all.

Another advantage of the above-described design and assembly method is the flexibility it allows in the design of the flow splitter 11. Generally, in conventional systems and as shown in FIG. 1 as the weld 31, a weld is required at the upstream interface between the outer sidewall 46 and the outer ring 20. Because of the axial clearance required to make this weld, the outward radial height of the vertical extension 22 of the flow splitter 11 had to be less than the outward radial height of upstream interface between the outer sidewall 46 and the outer ring 20. With the upstream weld no longer required, the axial clearance is no longer required such that the radial height of the flow splitter 21 may be increased, which may improve the flow characteristics in the inlet steam bowl 23. In addition, because of the axial clearance required to make the upstream weld between the upstream interface between the outer sidewall 46 and the outer ring 20, the flow splitter 11, in conventional systems, was constructed in two parts so that the assembly of each side of the double flow system could occur separately before the flow splitter 11 was connected the by bolted connection 24. With the upstream weld no longer required, a two piece flow splitter 11 also is no longer needed, and a single piece flow splitter (not shown) may be used.

Though not illustrated, in an alternative embodiment, the attachment systems of the inner sidewall 44 and outer sidewall 46 (as depicted in FIG. 2) may be interchanged. Accordingly, the interface between the outer sidewall 46 and the outer ring 20 may have the radial interlock 48 and downstream lip 58 (as described previously for the inner sidewall 44). And, the interface between the inner band 44 and the horizontal extension 21 may have the radial male/female interface 52 (as described previously for the outer sidewall 46). In such an embodiment, except for taking into account the switching of the attachment systems, the method of assembly may proceed as described above.

Figure 3:
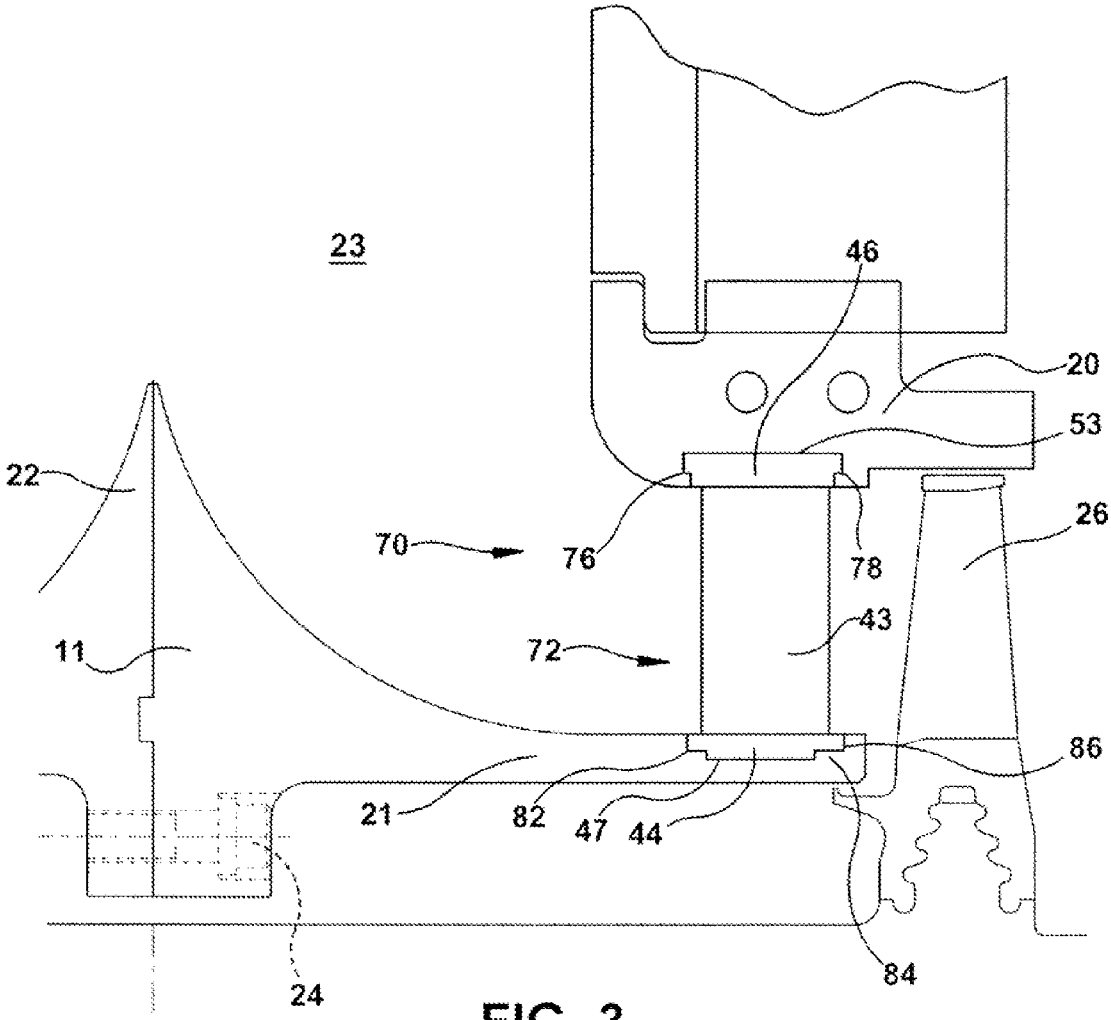
FIG. 3 is a schematic line drawing illustrating a cross-section through the first stage of a double flow steam turbine incorporating a nozzle assembly in accordance with an alternative embodiment of the present application.

Referring now to FIG. 3, there is illustrated an alternative embodiment to the present invention, a first stage nozzle assembly 70 that utilizes a first stage singlet 72. In this embodiment, the interface at slot 53 between the outer sidewall 46 and the outer ring 20 may include radial interlocks 76, 78 at both the upstream and downstream side of the outer sidewall 46. The radial interlocks 76, 78 may be similar to the radial interlock 48 described in relation to the embodiment of FIG. 2, and thus allow for a sliding engagement between the outer sidewall 46 and the outer ring 20 and, once engaged, prevent radial movement. The interface at slot 47 between the horizontal extension 21 and the inner sidewall 44 may include radial male/female interfaces 82, 84. The male/female interface 82 may not be included in some embodiments. Similar to male/female interface 54, the male/female interface 84 may provide a weld stop (which may promote a determined, shallow depth weld for the efficient attachment of the inner sidewall 44 to the horizontal extension 21) and a failsafe (i.e., a mechanical stop or retainment feature that may hold the installed nozzle in place axially in the event of a weld failure). The male/female interfaces 82, 84 may include a radial female recess in the inner sidewall 44 that corresponds with a radial male step on the horizontal extension 21.

The configuration of first stage nozzle assembly 70 may allow for the efficient installation of first stage singlet 72, which may proceed as follows. The outer sidewall 46 of the first stage singlet 72 may be slid into the slot 53 and, thus, engage the outer ring 20 through the configuration of the radial interlocks 76, 78. The inner sidewall 44 then may be introduced into the slot 47 of the horizontal extension 21 and the male/female interfaces 82 and 84 aligned. The features of the slot 47 and slot 53, i.e., the radial interlocks 76, 78 and the male/female interfaces 82, 84 may provide for the proper axial and radial alignment of the first stage singlet 72 during installation. The first stage singlet 72 then may be fixed into place between the horizontal extension 21 and the outer rings 20 by using a low heat input type weld 86 at the male/female interface 84, similar to that explained above for first stage singlet 42 and male/female interface 54. In some embodiments, the weld at the male/female interface 84 may not be used such that the first stage singlet 72 is mechanically held in place by the features of the slot 47 and slot 53.

Though not illustrated, in an alternative embodiment, the attachment systems of the inner sidewall 44 and outer sidewall 46 (as depicted in FIG. 3) may be interchanged. Accordingly, the interface between the outer sidewall 46 and the outer ring 20 may have the male/female interfaces 82, 84 (as described previously for the inner sidewall 44). And, the interface between the inner band 44 and the horizontal extension 21 may have the radial interlocks 76, 78 (as described previously for a the outer sidewall 46). In such an embodiment, except for taking into account the switching of the attachment systems, the methods of assembly may proceed as described above.

Figure 4:
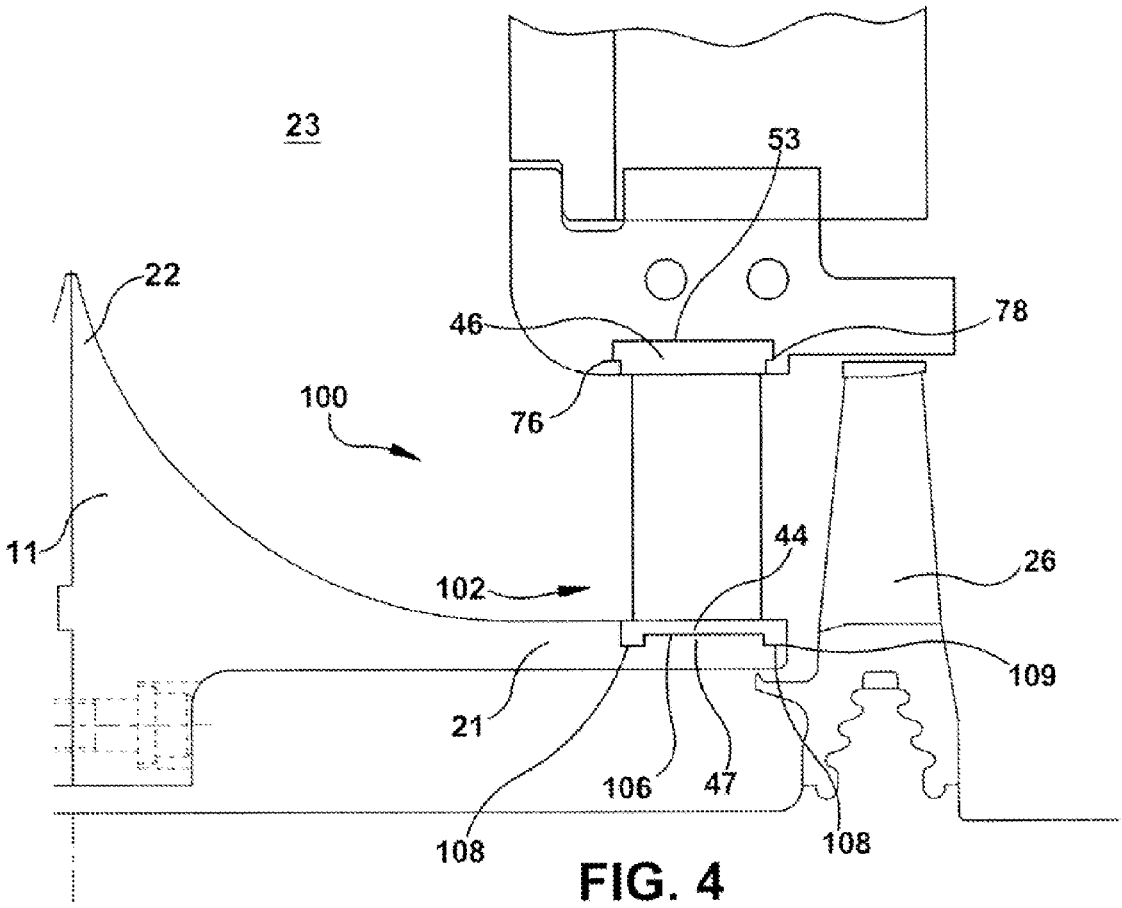
FIG. 4 is a schematic line drawing illustrating a cross-section through the first stage of a double flow steam turbine incorporating a nozzle assembly in accordance with an alternative embodiment of the present application.

Referring now to FIG. 4, there is illustrated an alternative embodiment to the present invention, a first stage nozzle assembly 100 that utilizes a first stage singlet 102. Similar to the embodiment of FIG. 3, in this embodiment, the interface at slot 53 between the outer sidewall 46 and the outer ring 20 may include radial interlocks 76, 78 at both the upstream and downstream side of the outer sidewall 46. As described, such an interface may allow for a sliding engagement between the outer sidewall 46 and the outer ring 20 and, once engaged, prevent radial movement. The interface at slot 47 between the horizontal extension 21 and the inner sidewall 44 may include a female recess 106 flanked or straddled by radially inwardly projecting male steps 108 at the leading and trailing edges of the inner sidewall 44. Similar to the male/female interface 54 and 84, the female recess 106/male steps 108 may provide a weld stop at the trailing edge (which may promote a determined, shallow depth weld for the efficient attachment of the inner sidewall 44 to the horizontal extension 21) and a failsafe (i.e., a mechanical stop or retainment feature that may hold the installed nozzle in place axially in the event of a weld failure).

The configuration of first stage nozzle assembly 100 may allow for the efficient installation of first stage singlet 102, which may proceed as follows. The first stage singlet 102 may be slid into the slot 53 and, thus, engage the outer ring 20 through the configuration of radial interlocks 76, 78. The inner sidewall 46 then may be introduced into the horizontal extension 21 at slot 47 and the female recess 106/males steps 108 aligned. The features of the slot 47 and slot 53, i.e., the radial interlocks 76, 78 and the female recess 106/males steps 108, may provide for the proper axial and radial alignment of the first stage singlet 102 during installation. The first stage singlet 102 then may be fixed into place between the horizontal extension 21 and the outer rings 20 by using a low heat input type weld 109 at the downstream edge of the inner sidewall 44, i.e., the male step 108/horizontal extension 21 interface at the downstream edge, similar to that explained above for first stage singlet 42 and male/female interface 54.

In some embodiments, the weld 109 at the downstream edge of the inner sidewall 44 may not be used such that the first stage singlet 102 is held in place by the mechanical features of the slot 47 and slot 53. Further, as demonstrated in FIG. 5, a bolt 112 may be introduced to augment the mechanical (non-weld) connection in this alternative embodiment. The bolt 112 may be a conventional bolt for such applications. The bolt 112 may extend in a radial direction through the horizontal extension 21 of the flow splitter 11 and into the inner sidewall 44. In some embodiments, the bolt 112 may terminate in the outer sidewall 112. In other embodiments, as shown, the bolt 112 may extend into the airfoil 43 of the first stage singlet 102.

Figure 5:
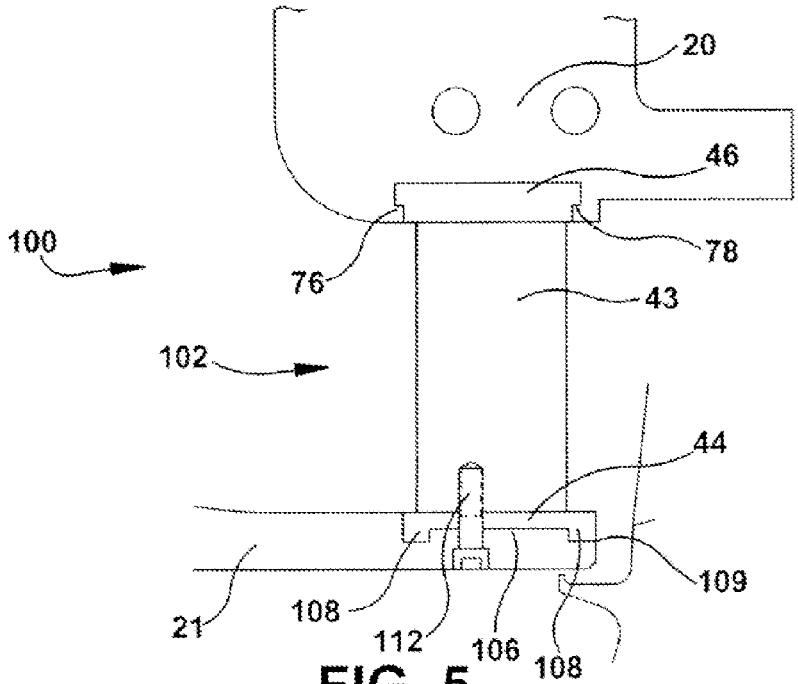
FIG. 5 is a schematic line drawing illustrating a cross-section through the first stage of a double flow steam turbine incorporating a nozzle assembly in accordance with an alternative embodiment of the present application.

Alternatively, though not illustrated, in an alternative embodiment, the attachment systems of the inner sidewall 44 and outer sidewall 46 (as depicted in FIGS. 4 and 5) may be interchanged. Accordingly, the interface between the outer sidewall 46 and the outer ring 20 may have the female recess 106/male steps 108 and/or the bolt 112 (as described previously for the inner sidewall 44). Note, however, that in some applications the bolt 112 may be more efficiently applied through the horizontal extension 21 of the flow splitter than the outer ring 20. And, the interface between the inner band 44 and the horizontal extension 21 may have the radial interlocks 76,78 (as described previously for the outer sidewall 46). In such an embodiment, except for taking into account the switching of the attachment systems, the method of assembly may proceed as described above.

Figure 6:
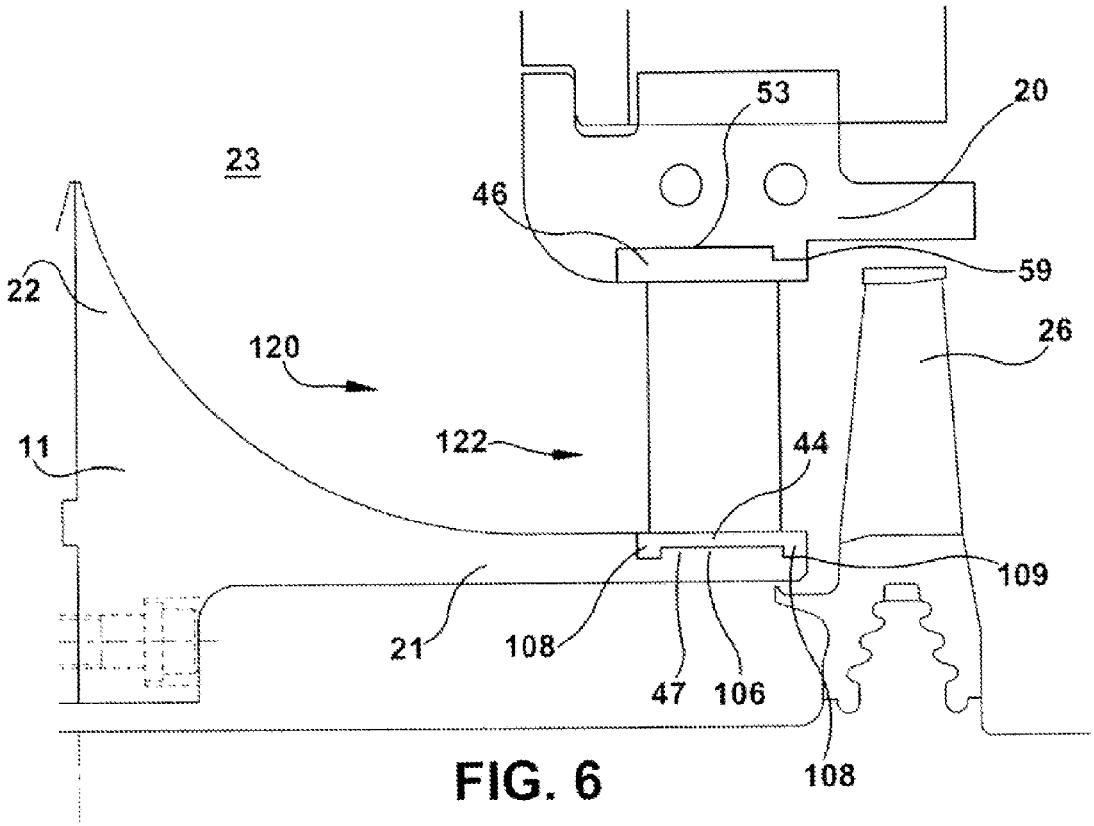
FIG. 6 is a schematic line drawing illustrating a cross-section through the first stage of a double flow steam turbine incorporating a nozzle assembly in accordance with an alternative embodiment of the present application.

Referring now to FIG. 6, there is illustrated an alternative embodiment to the present invention, a first stage nozzle assembly 120 that utilizes a first stage singlet 122. Similar to the embodiment of FIG. 4, the interface at slot 47 between the horizontal extension 21 and the inner sidewall 44 may include a female recess 106 flanked or straddled by radially inwardly projecting male steps 108 at the leading and trailing edges of the inner sidewall 44. The female recess 106/males steps 108 may provide a weld stop (which may promote a determined, shallow depth weld for the efficient attachment of the inner sidewall 44 to the horizontal extension 21) and a failsafe (i.e., a mechanical stop or retainment feature that may hold the installed nozzle in place axially in the event of a weld failure). In the embodiment of FIG. 6, the interface at slot 53 between the outer sidewall 46 and the outer ring 20 may be similar to that described for the embodiment of FIG. 2. Accordingly, at the downstream side of the slot 53, the radial male/female interface 54 may be formed, which may provide a weld stop (which may promote a determined, shallow depth weld for the efficient attachment of the outer sidewall 46 to the outer ring 20) and a failsafe (i.e., a mechanical stop or retainment features that may hold the installed nozzle in place axially in the event of a weld failure). The male/female interface 54 may include a radial female recess in the outer sidewall 46 that corresponds with a male step on the outer ring 20.

The configuration of first stage nozzle assembly 120 may allow for the efficient installation of first stage singlet 122, which may proceed as follows. The first stage singlet 122 may be placed into the slot 53 and the male/female interface 54 aligned. The inner band 46 may be introduced into the horizontal extension 21 at slot 47 and the female recess 106/males steps 108 aligned. The features of the slot 47 and slot 53, i.e., the male/female interface 54 and the female recess 106/males steps 108, may provide for the proper axial and radial alignment of the first stage singlet 122 during installation. The first stage singlet 122 then may be fixed into place between the horizontal extension 21 and the outer rings 20 by using the low heat input type weld 109 at the downstream edge of the female recess 106/males steps 108 interface and the low heat input type weld 59 at male/female interface 54 in the manner described above.

Alternatively, though not illustrated, in alternative embodiment, the attachment systems of the inner sidewall 44 and outer sidewall 46 (as depicted in FIG. 6) may be interchanged. Accordingly, the interface between the outer sidewall 46 and the outer ring 20 may have the female recess 106/male steps 108 (as described previously for the inner sidewall 44). And, the interface between the inner band 44 and the horizontal extension 21 may have the radial male/female interface 54 (as described previously for the outer sidewall 46). In such an embodiment, except for taking into account the switching of the attachment systems, the assembly may proceed as described above.

Figure 7:
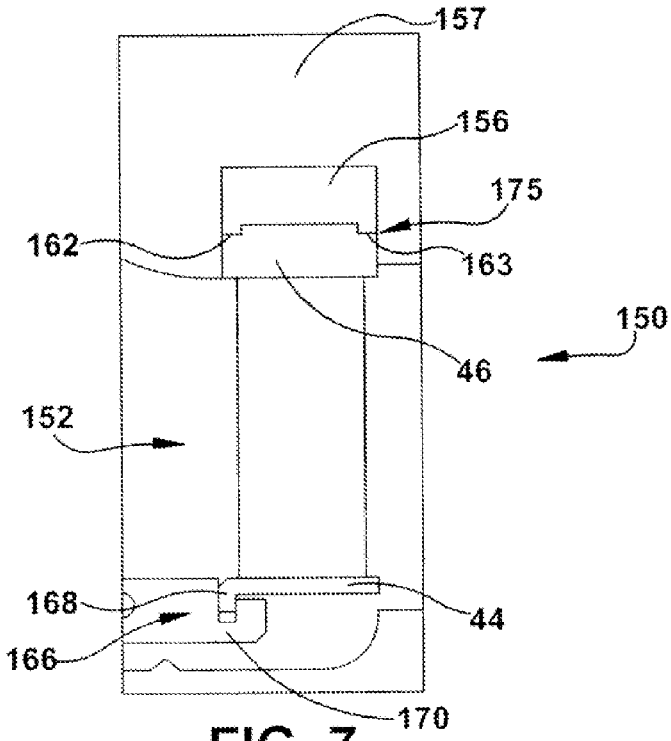
FIG. 7 is a schematic line drawing illustrating a cross-section through the first stage of a double flow steam turbine incorporating a nozzle assembly in accordance with an alternative embodiment of the present application.

Referring now to FIG. 7, there is illustrated an alternative embodiment to the present invention, a first stage nozzle assembly 150 that utilizes a first stage singlet 152. At the outer sidewall 46, this embodiment demonstrates how the current concepts also may be used with band/ring construction, which may include a solid band or ring 156 fitted within an outer carrier ring 157. Band/ring construction may include an interface between the outer sidewall 46 and the solid ring 156, which may be similar to the interface made between the outer sidewall 46 and the outer ring 20 in the embodiments discussed above.

As illustrated, the interface between the outer sidewall 46 and the solid ring 156 may include a male/female interfaces 162, 163 at both the leading and trailing edges of the outer sidewall 46. In some embodiments, only one of the male/female interfaces may be used. Similar to male/female interface 54, the male/female interfaces 162, 163 may provide a weld stop (which may promote a determined, shallow depth weld for the efficient attachment of the inner sidewall 44 to the horizontal extension 21) and a failsafe (i.e., a mechanical stop or retainment feature that may hold the installed nozzle in place axially in the event of a weld failure). The male/female interfaces 162, 163 may include a radial female recess in the outer sidewall 46 that corresponds with a radial male step on the solid ring 156.

The interface between the inner sidewall 44 and the horizontal extension 21 may include a hook and slot connection 166. The hook and slot connection 166 may include a hook 168 that extends radially from the leading edge of inner sidewall 44. A narrow circumferential slot 170 may be formed in the horizontal extension 21 of the flow splitter 11. The slot 170 may be sized such that it may be engaged by the hook 168.

The configuration of first stage nozzle assembly 150 may allow for the efficient installation of first stage singlet 152, which may proceed as follows. The hook 168 of the inner sidewall 44 may be inserted into the slot 170. The outer sidewall 46 then may align with the solid ring 156 such that males step 160/female recesses 162 are aligned. The hook and slot connection 166 and the males step 160/female recesses 162 may provide for the proper axial and radial alignment of the first stage singlet 102 during installation. The first stage singlet 102 then may be fixed into place between the horizontal extension 21 and the solid ring 156/outer carrier ring 157 by using a low heat input type weld 175 at the downstream edge of the interface between the solid ring 156 and the outer sidewall 46, similar to the welding process explained above. Note that the hook and slot connection may be used opposite the other attachment systems described above and is not limited to being used opposite band/ring construction or the specific interface construction described in relation to the embodiment of FIG. 7.

From the above description of preferred embodiments of the invention, those skilled in the art will perceive improvements, changes and modifications. Such improvements, changes and modifications within the skill of the art are intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. A nozzle assembly for a turbine comprising:

a nozzle blade having inner and outer sidewalls, and, in part, defining a flowpath upon assembly into the turbine;

an outer ring;

a flowsplitter having a horizontal extension;

an interface between the outer ring and the outer sidewall having at least one of (i) a male/female interface or (ii) a radial interlock; and an interface between the horizontal extension and the inner sidewall having at least one of (i) the male/female interface or (ii) the radial interlock;

wherein:

the radial interlock comprises either a first male step projecting axially from the inner sidewall into the horizontal extension, the first male step being flanked on its most outwardly radial side by a second male step projecting axially from the horizontal extension into the inner sidewall, or a first male step projecting axially from the outer sidewall into the outer ring, the first mail step being flanked on its most inwardly radial side by a second male step projecting axially from the outer ring into the outer sidewall;

the male/female interface comprises either a radial female recess on the outer sidewall that corresponds with a radial male step on the outer ring, or a radial female recess in the inner sidewall that corresponds to a radial male step on the horizontal extension;

the interface between the outer ring and the outer sidewall comprises the male/female interface positioned at a trailing edge of the outer sidewall;

the interface between the horizontal extension and the inner sidewall comprises the radial interlock positioned at a leading edge of the inner sidewall;

the male/female interface positioned at the trailing edge of the outer sidewall is welded, the weld comprising a butt weld such that the weld is substantially limited to the area between the outer sidewall and the outer ring along the axial length of male/female interface; and the axial length of male/female interface positioned at the trailing edge of the outer sidewall is less than about ¼ of the axial extent of the registration between the outer ring and the outer sidewall.

2. The nozzle assembly according to claim 1, wherein one of the interface between the outer ring and the outer sidewall and the interface between the horizontal extension and the inner sidewall comprises a weld and one of the interface between the outer ring and the outer sidewall and the interface between the horizontal extension and the inner sidewall is weld free.

3. The nozzle assembly according to claim 1, wherein the horizontal extension further includes a downstream lip, the downstream lip covering the downstream edge of the inner sidewall such that the downstream lip prevents axial displacement of the inner sidewall in the downstream direction.

4. A nozzle assembly for a turbine comprising:

a nozzle blade having inner and outer sidewalls and, in part, defining a flowpath upon assembly into the turbine;

an outer ring;

a flowsplitter having a horizontal extension;

an interface between the outer ring and the outer sidewall having at least one of (i) a male/female interface or (ii) a radial interlock; and an interface between the horizontal extension and the inner sidewall having at least one of (i) the male/female interface or (ii) the radial interlock;

wherein:

the interface between the outer ring and the outer sidewall comprises one of the radial interlocks positioned at both a leading edge and a trailing edge of the outer sidewall; and the interface between the horizontal extension and the inner sidewall comprises the male/female interface positioned at a trailing edge of the inner sidewall.

5. The nozzle assembly according to claim 4, wherein the male/female interface positioned at the trailing edge of the inner sidewall is welded using a butt weld interface such that the weld is substantially limited to the area between the inner sidewall and the horizontal extension along the axial length of male/female interface; and wherein the axial length of male/female interface positioned at the trailing edge of the inner sidewall is less than about ¼ of the axial extent of the registration between the inner sidewall and the horizontal extension.

6. A nozzle assembly for a turbine comprising:

a nozzle blade having inner and outer sidewalls, and, in part, defining a flowpath upon assembly into the turbine;

an outer ring;

a flowsplitter having a horizontal extension;

an interface between the outer ring and the outer sidewall having at least one of (i) a radial interlock; (ii) a male/female interface; or (iii) a female recess flanked by radially projecting male steps at both a leading and a trailing edge of the outer sidewall; and an interface between the horizontal extension and the inner sidewall having at least one of (i) the radial interlock; (ii) the male/female interface; or (iii) the female recess flanked by radially projecting male steps at both a leading and a trailing edge of the inner sidewall;

wherein the outer ring comprises a solid ring and an outer carrier ring assembly.

7. The nozzle assembly according to claim 6, wherein the radial interlock comprises either (i) a first male step projecting axially from the inner sidewall into the horizontal extension, the first male step being flanked on its most outwardly radial side by a second male step projecting axially from the horizontal extension into the inner sidewall, or (ii) a first male step projecting axially from the outer sidewall into the outer ring, the first mail step being flanked on its most inwardly radial side by a second male step projecting axially from the outer ring into the outer sidewall; and wherein the male/female interface comprises either (i) a radial female recess on the outer sidewall that corresponds with a radial male step on the outer ring, or (ii) a radial female recess in the inner sidewall that corresponds to a radial male step on the horizontal extension.

8. The nozzle assembly according to claim 7, wherein the interface between the outer ring and the outer sidewall comprises one of the radial interlocks positioned at the leading edge and the trailing edge of the outer sidewall; and the interface between the horizontal extension and the inner sidewall comprises the female recess flanked by radially projecting male steps at the leading edge and the trailing edge of the inner sidewall.

9. The nozzle assembly according to claim 8, wherein the interface between the male step at the trailing edge of the inner sidewall and the horizontal extension is welded, the weld comprising a butt weld such that the weld is substantially limited to the area between the inner sidewall and the horizontal extension along the axial length of male step at the trailing edge of the inner sidewall; and wherein the axial length of male step positioned at the trailing edge of the inner sidewall is less than about ¼ of the axial extent of the registration between the inner sidewall and the horizontal extension.

10. The nozzle assembly according to claim 8, wherein the inner sidewall is bolted to the horizontal extension by a bolt, the bolt being positioned such that the bolt extends radially through the horizontal extensions into the inner sidewall.

11. The nozzle assembly according to claim 7, wherein the interface between the outer ring and the outer sidewall comprises the male/female interface positioned at the trailing edge of the outer sidewall; and the interface between the horizontal extension and the inner sidewall comprises the female recess flanked by radially projecting male steps at the leading and the trailing edges of the inner sidewall.

12. The nozzle assembly according to claim 11, wherein the interface between the male step at the trailing edge of the inner sidewall and the horizontal extension is welded, the weld comprising a butt weld such that the weld is substantially limited to the area between the inner sidewall and the horizontal extension along the axial length of the male step at the trailing edge of the inner sidewall; and wherein the axial length of male step at the trailing edge of the inner sidewall is less than about ¼ of the axial extent of the registration between the inner sidewall and the horizontal extension.

13. The nozzle assembly according to claim 11, wherein the male/female interface positioned at the trailing edge of the outer sidewall is welded, the weld comprising a butt weld such that the weld is substantially limited to the area between the outer sidewall and the outer ring along the axial length of male/female interface; and wherein the axial length of male/female interface positioned at the trailing edge of the outer sidewall is less than about ¼ of the axial extent of the registration between the outer sidewall and the outer ring.

14. The nozzle assembly according to claim 6, wherein the flow splitter comprises a single piece and an vertical extension of the flow splitter comprises a greater outward radial height than the outward radial height of upstream interface between the outer sidewall and the outer ring.

15. A nozzle assembly for a turbine comprising:

a nozzle blade having inner and outer sidewalls, and, in part, defining a flowpath upon assembly into the turbine;

an outer ring;

a flowsplitter having a horizontal extension;

means for providing a mechanical engagement that includes a radial interlock between an interface between the outer ring and the outer sidewall; and means for providing a mechanical engagement that includes a weld stop and a failsafe between an interface between the inner ring and the horizontal extension;

wherein the male/female interface comprises a radial female recess on the inner sidewall that corresponds with a radial male step on the horizontal extension.

16. The nozzle assembly according to claim 15, wherein the weld stop includes a backstop that determines the depth of a weld at the interface; and the failsafe includes a mechanical stop that prevents the downstream axial displacement of the outer sidewall.

17. The nozzle assembly according to claim 15, wherein the means for providing a mechanical engagement that includes a weld stop and a failsafe comprise either (i) a male/female interface or (ii) a female recess flanked by radially projecting male steps at both a leading edge and a trailing edge of the inner sidewall.

18. The nozzle assembly according to claim 15, wherein the means for providing a mechanical engagement that includes a radial interlock comprises a first male step projecting axially from the outer sidewall into the outer ring, the first mail step being flanked on its most inwardly radial side by a second male step projecting axially from the outer ring into the outer sidewall.

19. A nozzle assembly for a turbine comprising:

a nozzle blade having inner and outer sidewalls, and, in part, defining a flowpath upon assembly into the turbine;

an outer ring;

a flowsplitter having a horizontal extension;

an interface between the outer ring and the outer sidewall having at least one of (i) a radial interlock; (ii) a male/female interface; or (iii) a female recess flanked by radially projecting male steps at both a leading edge and a trailing edge of the outer sidewall; and an interface between the horizontal extension and the inner sidewall having a hook and slot connection;

wherein the outer ring comprises a solid ring and an outer carrier ring assembly.

20. The nozzle assembly according to claim 19, wherein the hook and slot connection includes a hook that extends radially from the leading edge of inner sidewall and a corresponding circumferential slot in the horizontal extension.

21. The nozzle assembly according to claim 20, wherein the interface between the outer ring and the outer sidewall comprises a male/female interface positioned at both the leading and the trailing edge of the outer sidewall.

22. The nozzle assembly according to claim 21, wherein the male/female interface positioned at the trailing edge of the outer sidewall is welded, the weld comprising a butt weld such that the weld is substantially limited to the area between the outer sidewall and the outer ring along the axial length of male/female interface; and wherein the axial length of male/female interface positioned at the trailing edge of the outer sidewall is less than about ¼ of the axial, extent of the registration between the outer ring and the outer sidewall.

* * * * *